US005839022A

United States Patent [19]

Wang et al.

[11] Patent Number: 5,839,022

[45] Date of Patent: Nov. 17, 1998

[54] FILTER FOR REDUCING THE EFFECT OF NOISE IN TC CONTROL

[75] Inventors: Yao Rong Wang, Webster; Lingappa K. Mestha, Fairport, both of N.Y.

[73] Assignee: Xerox Corporation, Stamford, Conn.

[21] Appl. No.: 757,032

[22] Filed: Nov. 26, 1996

[51] Int. Cl.[6] ..... G03G 15/08

[52] U.S. Cl. ..... 399/62; 399/30

[58] Field of Search ..... 399/62, 64, 30, 399/58

[56] References Cited

U.S. PATENT DOCUMENTS

| | | | |
|---|---|---|---|
| 4,108,545 | 8/1978 | Eckert et al. | 399/64 |
| 4,369,733 | 1/1983 | Hirakura et al. | 399/64 |
| 4,980,727 | 12/1990 | Stelter | 399/64 |
| 5,237,370 | 8/1993 | Murai | 399/62 X |

FOREIGN PATENT DOCUMENTS

| | | |
|---|---|---|
| 59-116771 | 7/1984 | Japan . |
| 61-013268 | 1/1986 | Japan . |
| 3-143229 | 6/1991 | Japan . |

*Primary Examiner*—Fred L. Braun
*Attorney, Agent, or Firm*—Ronald F. Chapuran

[57] ABSTRACT

In an imaging machine including an imaging member, operating components including a toner dispense system including a source of toner material and a dispenser for transferring toner material from the source to a developer device to replenish the developer device with toner material, and a control to provide images on copy sheets, a smart sensor system including a sensor, a toner concentration reference, and a filter. The sensor provides signals representing the toner concentration and the filter interconnected to the sensor and to the toner concentration reference reduces error in the signals representing the toner concentration. A comparator responding to the toner concentration reference and the filter signals provides an error signal to the control system in turn providing a toner dispense signal.

18 Claims, 5 Drawing Sheets

FILTER FOR REDUCING THE EFFECT OF NOISE IN TC CONTROL

This invention relates generally to an imaging machine and, more particularly, to the control of toner concentration.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In an electrophotographic apparatus, an electrostatic image, formed on the surface of a drum or web, is developed by the application of finely divided toner particles to form a toner image. In certain electrophotographic apparatus, toner images are formed from electrostatic images by brushing a developer mixture of ferromagnetic carrier particles and smaller toner particles across the electrostatic images. The contact of the ferromagnetic particles with the toner particles charges the toner particles by triboelectrification to a polarity needed in order that the toner particles are attracted to the electrostatic images for toning.

In the process of attracting toner particles to electrostatic images for toning, toner particles are depleted from the developer mixture requiring replenishment to avoid a gradual reduction in density of the toner images. Toner replenishment is accomplished by several different types of apparatus. In one type, a given amount of toner is added to the mixture after a given number of copies is made. This approach is acceptable if the amount of toner used for each copy is reasonably predictable. In some apparatus, however, the amount of toner used in any copy or group of copies can vary substantially. For this reason, toner concentration monitors have been designed which automatically add toner according to the results of a monitoring process.

U.S. Pat. No. 2,956,487 generally shows the use of control signals to activate a vibrator to add developer particle powders from a reservoir to a magnetic brush trough. U.S. Pat. Nos. 3,348,522, 3,348,523 and 3,376,853 disclose a reflective type sensor for use in closed loop automatic development control. A clean drum signal is compared to a signal reflected from a test pattern formed on the drum. Separate sensors are utilized for detecting each signal. The outputs of the sensors are compared by a bridge circuit to provide an error signal and a toner dispenser is operated in response to the error signal. In these system, the degree of development is measured directly from a developed test stripe on the photoreceptor drum extending along the peripheral edge of the drum.

In systems such as shown in U.S. Pat. Nos. 3,873,002 and 4,065,031, an electrically biased transparent electrode disposed on the photoreceptor surface is conveyed past the development station to attract toner particles. Light is transmitted from within the photoreceptor through the transparent electrode and detected by a photosensor located near the surface. The photosensor provides a signal indicative of the density of toner particles on the transparent electrode. A disadvantage with systems of this type is the relative cost due to the complexity and number of components required.

Other examples of analog control are the use of a funnel in the developer apparatus to collect developing material. An inductance coil is wound about the funnel and connected to the motor of a toner dispenser through a bridge circuit. The reactance of the inductance coil varies in accordance to percentage of toner contained in the developing material. Other systems such as disclosed in U.S. Pat. No. 3,719,165 control a toner replenisher by measuring the electric potential of a magnetic developing brush. In U.S. Pat. No. 3,876,106, light is reflected from a development brush to measure the concentration of toner in the developer housing. The reflective signal is fed to a computer and the computer determines whether or not the toner could be added and controls a toner replenishment device accordingly. In other approaches to improve toning, often referred to as "Auto-Bias", the potential of an electrode in the development station is adjusted as a function of the charge density of the electrostatic image. See, for example, U.S. Pat. No. 3,779,204 teaching the use of an electrometer probe disposed near a photoreceptor belt to provide "Auto-Bias" and also to produce a signal to actuate a toner dispenser through threshold circuitry.

Other systems control toner dispensers by measuring toner concentration in the developer mixture contained in a developer housing or reservoir. For example, U.S. Pat. No. 3,233,781 discloses reflecting a light beam from the developer mixture. The measure of the reflectivity of the mixture manifests the proportion of toner to carrier concentration in the mixture. Disadvantages with systems of this type are due in part to "noise" generated in the system, to the fact that the system is only an analog of the amount of toner actually applied to the photoreceptor surface, and to the dependence of the system to the constituents of the developer mixture.

A difficulty with the prior art is the requirement of a control to keep the toner concentration (TC) constant for a long print job. The basic control loop includes making TC measurement on a regular basis using suitable sensors and then comparing the sensor values with the setpoints known as targets. The sensor measurement generally contains noise. The performance of the TC controller, and ultimately, the print quality, is therefore adversely affected by the sensor noise. The problem is compounded due to actuator limitation which occurs because the noise can give a negative control signal (i.e., demanding to take toner out of the housing), but no toner can be consumed when not making prints. Under this condition, the steady state error is not zero as desired, but increases with the increase of the noise amplitude. It would be desirable, therefore, to be able to filter and reduce the effect of noise in the TC control loop for improved toner concentration control.

It is an object of the present invention, therefore, to introduce a filter into the toner concentration control loop for reducing the effect of TC sensor measurement noise, and allowing a better control of toner concentration. It is another object of the present invention to provide a filter that accommodates the long delay in the toner delivering process. Further advantages of the present invention will become apparent as the following description proceeds, and the features characterizing the invention will be pointed out with particularity in the claims annexed to and forming a part of this specification.

SUMMARY OF THE INVENTION

The present invention relates to an imaging machine consisting of an imaging member, operating components including a toner dispense system having a source of toner material and a dispenser for transferring toner material from the source to a developer device to replenish the developer device with toner material, and a control to provide images on copy sheets. A smart sensor system includes a sensor, and a filter, with a toner concentration reference as the input. The sensor provides signals representing the toner concentration and the filter interconnected to the sensor and to the toner concentration reference reduces error in the signals representing the degree of toner concentration. A comparator responding to the toner concentration reference and the filter signals provides an error signal to the control system in turn providing a toner dispense signal.

Other features of the present invention will become apparent as the following description proceeds and upon reference to the drawings, in which.

Figure 1:
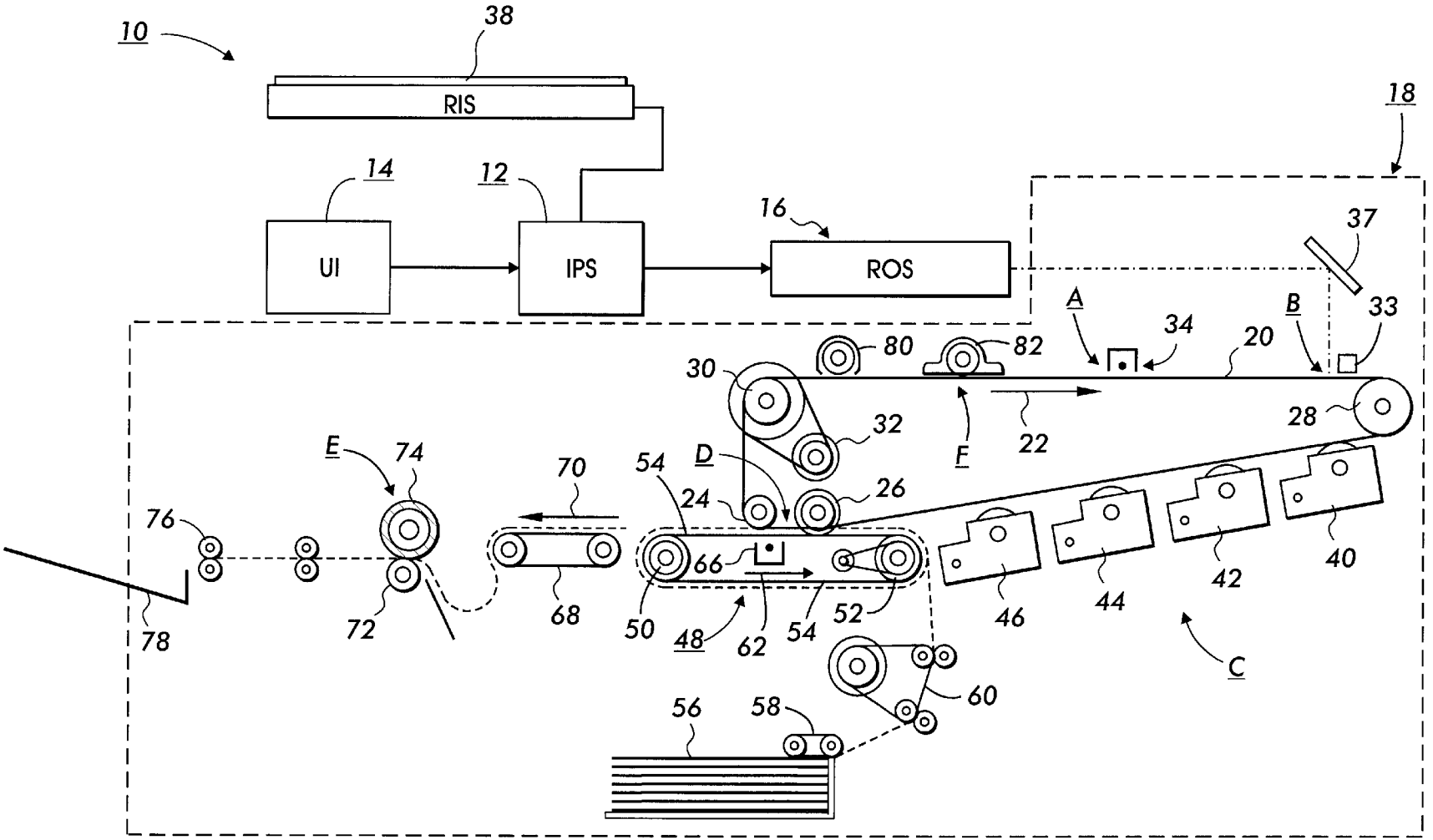
FIG. 1 is a schematic elevational view of an exemplary multi-color electrophotographic printing machine which can be utilized in the practice of the present invention.

A schematic elevational view showing an exemplary electrophotographic printing machine incorporating the features of the present invention therein is shown in FIG. 1. It will become evident from the following discussion that the present invention is equally well-suited for use in a wide variety of printing systems including ionographic printing machines and discharge area development systems, as well as other more general nonprinting systems providing multiple variable outputs such that the invention is not necessarily limited in its application to the particular system shown herein.

To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 1, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In the transfer zone, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

Figure 2:
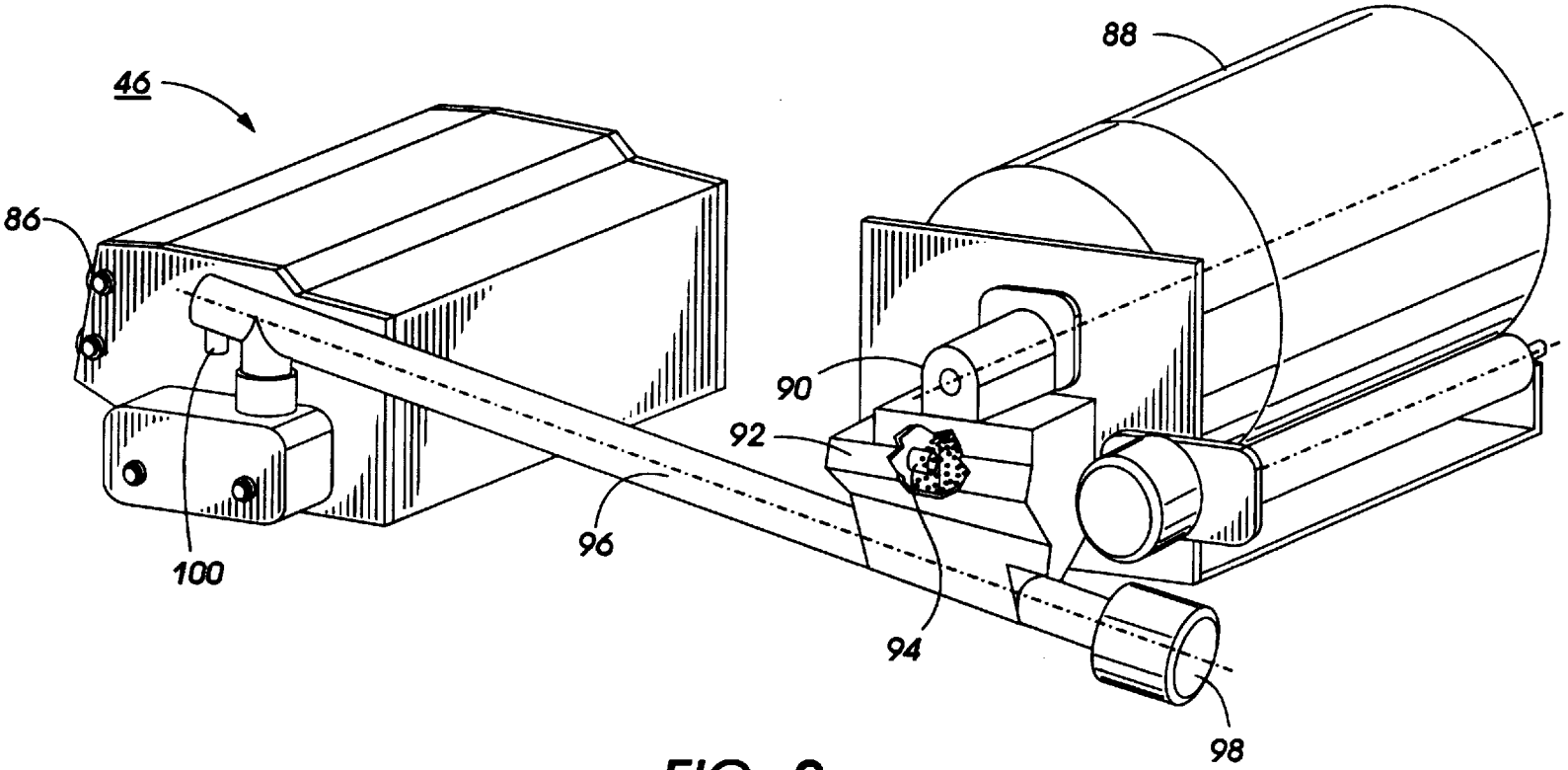
FIG. 2 illustrates a developer unit including a toner dispensing device for use with the present invention.

FIG. 2 shows in greater detail one of the developer units such as 46 illustrated in FIG. 1. The developer unit includes a developer 86 such as a mag brush developer for applying toner to a latent image. The magnetic brush developer is generally provided in a developer housing and the rear of the housing usually forms a sump containing a supply of developing material. A (not shown) passive crossmixer in the sump area generally serves to mix the developing material. It should be noted that mag brush development is only one example of a development system contemplated within the scope of the present invention.

As will be understood by those skilled in the art, the electrostatically attractable developing material commonly used in magnetic brush developing apparatus comprises a pigmented resinous powder, referred to as toner and larger granular beads referred to as carrier. To provide the necessary magnetic properties, the carrier is comprised of a magnetizable material such as steel. By virtue of the magnetic field established by the magnetic brush developer, a blanket of developing material is formed along the surface of the magnetic brush developer adjacent the photoreceptor surface. Toner is attracted to the electrostatic latent image from the carrier beads to produce a visible powder image on the surface..

The developer 86 is connected to a toner dispense assembly including a toner bottle 88 providing a source of toner particles, an extracting auger 90 for dispensing toner particles from bottle 88, and hopper 92 receiving toner particles from auger 90. Hopper 92 is also connected to delivery auger 96 and delivery auger is rotated by drive motor 98 to convey toner particles from hopper 92 for distribution to developer 86. A suitable low toner level sensor shown at 94 provides signals to the system control that toner bottle 88 must be re-filled or replaced and a suitable toner concentration sensor illustrated at 100 within the developer housing provides signals to the system control indicative of the toner concentration or ratio of toner and carrier in developer 86.

In a preferred embodiment, toner concentration sensor 100 is a magnetic permeability sensor for distinguishing the magnetic characteristics of toner and carrier particles within developer 86. One such sensor is the well known magnetic permeability Packer sensor. It should be noted, however, that the scope of the present invention is intended to apply to the use of other types of toner concentration sensors either within the developer housing or located adjacent the photoreceptor such as well known LED-Photodetector devices to sense the degree of development of a portion of the surface of the photoreceptor.

Figure 3:
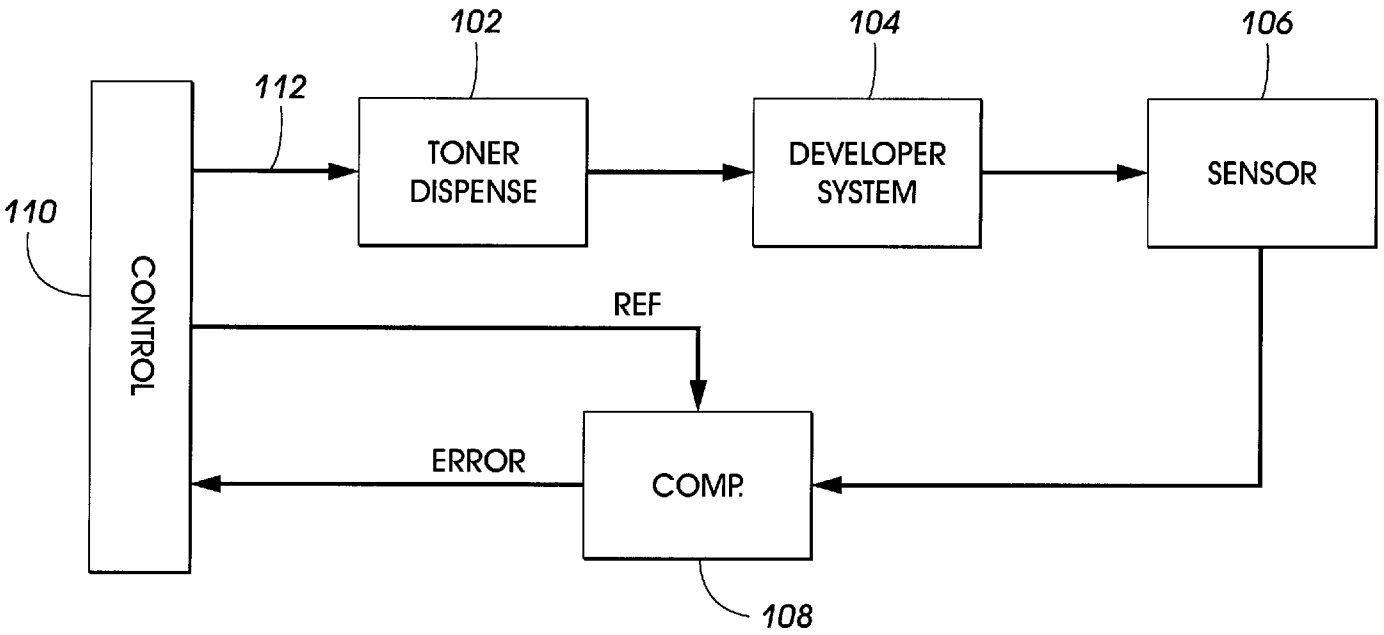
FIG. 3 PRIOR ART
FIG. 3 illustrates a typical prior art toner dispensing control.

A typical prior art toner dispense control is shown in FIG. 3. In particular, toner dispense system 102 replenishes the supply of toner of development system 104. A suitable sensor as illustrated at 106 provides a signal representative of toner concentration to comparator 108, also receiving an input reference signal from control 110. The comparator 108 responds to the signal representative of toner concentration and to the input reference signal to generate an error signal conveyed to control 110 which in turn provides a toner dispense signal 112 to toner dispense system 102 to add toner to developer system 104.

As stated above, sensor measurements generally contain noise and the performance of a TC controller, and ultimately, print quality, is therefore adversely affected by sensor noise. The problem is compounded due to actuator limitation which occurs because the noise can give a negative control signal (i.e., demanding to take toner out of the housing), but no toner can be consumed when not making prints. Under this condition, the steady state error is not zero as desired, but increases with the increase of the noise amplitude. It would be desirable to filter and reduce noise in the TC control loop for improved toner concentration control and a technique in accordance with the present invention to provide a suitable filter to reduce noise is discussed below.

Figure 4:
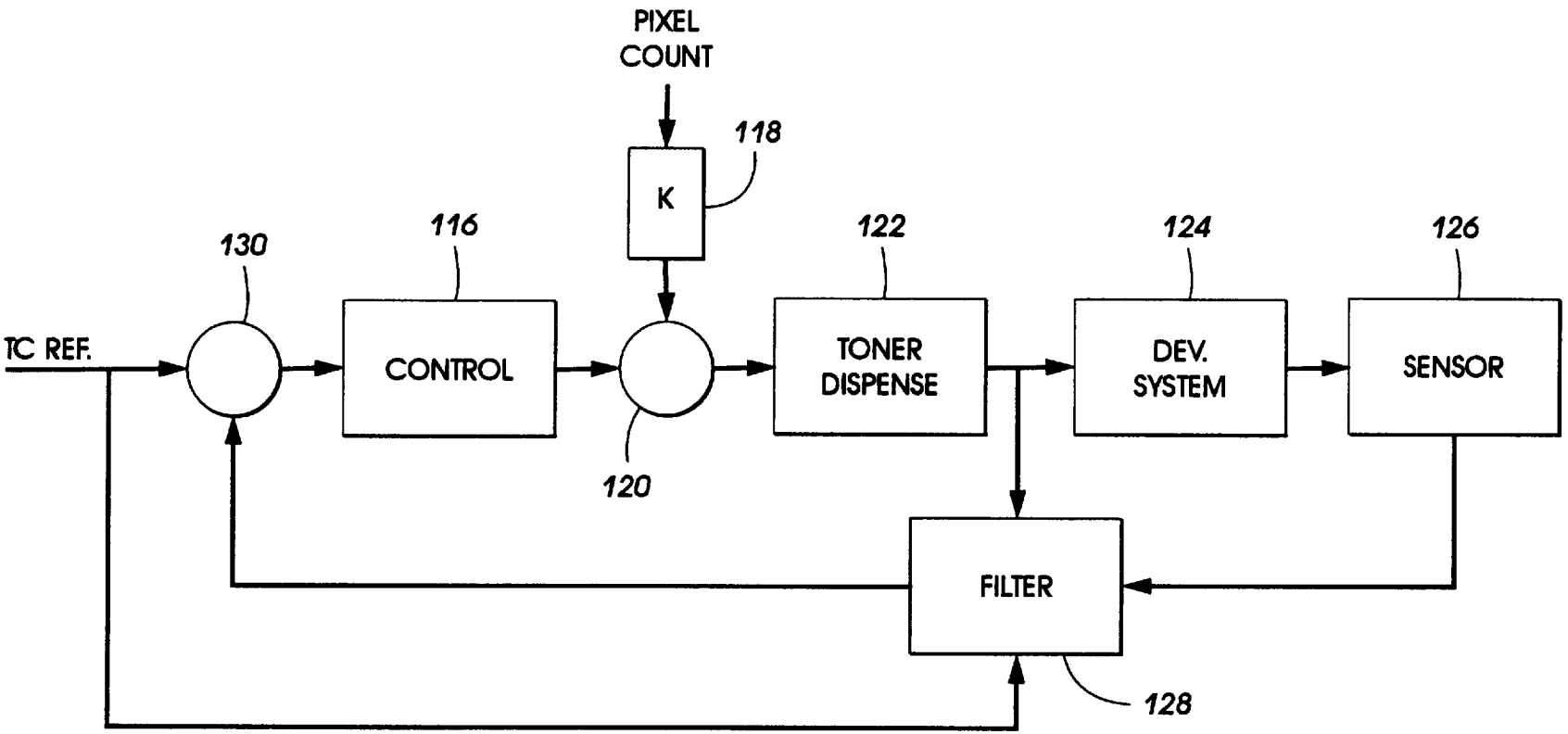
FIG. 4 illustrates a toner dispensing control in accordance with the present invention; an FIG. 5 is a mathematical relationship of the control of FIG. 4.
Figure 5:
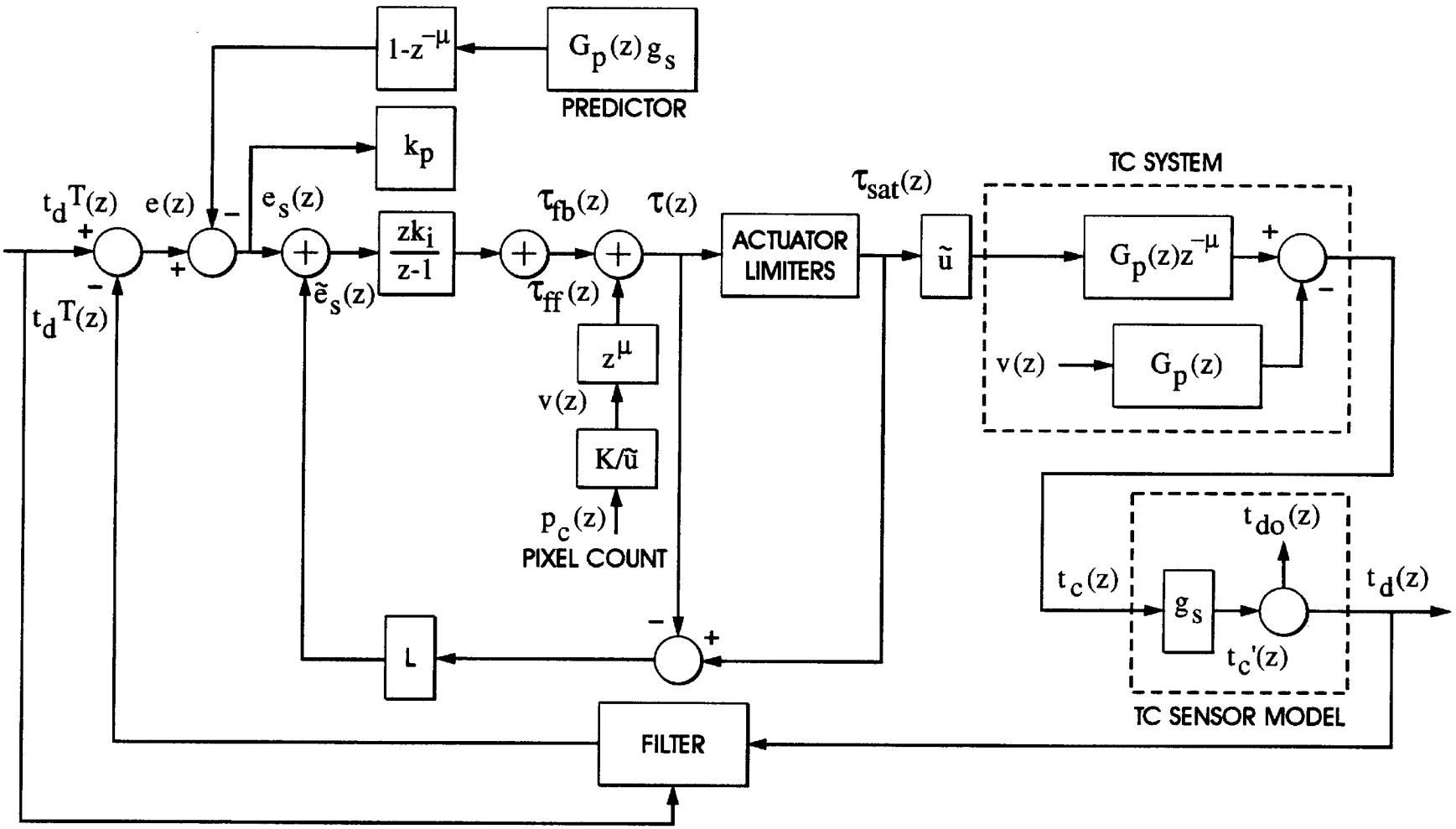

FIG. 4 illustrates a block diagram of a TC control loop in accordance with the present invention with the implementation of the noise reduction filter discussed above. In particular, toner dispense system 122 replenishes the supply of toner of development system 124. A suitable sensor as illustrated at 126 provides a signal representative of toner concentration to noise reduction filter 128, also receiving an input TC reference signal and a toner dispense signal from toner dispense 122. The filter 128 responds to the signal representative of toner concentration and to the TC reference and toner dispense signals to provide a filtered sensor signal to comparator 130, comparator 130 in turn generating an error signal conveyed to control 116. In response, control 116 provides a signal to comparator 120, also receiving a signal indicative of toner usage such as a pixel count signal, to generate a toner dispense signal to toner dispense 122 to add toner to developer system 124. FIG. 5 merely represents a mathematical relationship of the FIG. 4 control.

We now show the development of a TC control model before discussing the filter design, since the filter uses the control model. A typical TC sensor model is shown in FIG. 5, and is given by the following equation.

$$t_d(z)=g_s t_c(z)+t_{d0} \tag{1}$$

This relationship shows that the sensor reading, $t_d$, is a linear function of the actual TC value $t_c$, with a constant slope $g_s$ and an interception $t_{d0}$. This relationship is based on one set of experimental data, for which $g_s=-1.345$, and $t_{d0}=12.14$. It is expected that such a linear relation holds for most TC sensors, although the value of $g_z$ and $t_{d0}$ may vary. The sensor reading contains measurement noise. The actual TC value is determined by $$t_c(k+1)=t_c(k)+g[\mu u(k-\mu)-\nu(k)] \tag{2}$$

where k numbers the duty cycle, and g is a constant. Equivalently, using the z-transformation, $$t_c(z)=u(z)G_p(z)z^{-\mu}-\nu-v(z)G_p(z) \tag{3}$$

In Eq.(3), the first term describes toner supply, while the second term describes toner consumption. $\mu$ is the delay which varies depending on the printer. $u(z)=\tilde{u}\tau_{sat}(z)$ is the toner dispense rate. The constant $\tilde{u}$ is known for a typical experimental station, and $\tau$ is the duty cycle. Finally, $G_p(z)=g/(z-1)$.

The actuator limiter limits the maximum value of the duty cycle $\tau$, and simulates the fact that a negative dispense rate is not physically allowed. More precisely, we have $\tau_{sat}=\tau$ if $0\leqq\tau\leqq\tau_{max}$, $\tau_{sat}=0$ if $\tau\leqq 0$, and $\tau_{sat}\tau_{max}$ if $\tau\geqq\tau_{max}$. Because of this limitation, the steady state error, $e(k)=t_d^T-t_d(k)$, may not be zero for large k. Also, due to actuator limitation, integrators in the controller will cause undesired effect. Hence an antiwinding loop, with the gain shown as L, is designed. Notice also that the Smith predictor, characterized by the transfer function $(1-z^{-\mu})g_s G_p(z)$, is introduced to the system which allows the robust design of the controller in the presence of system delay.

The basic controller of the TC loop is the PI controller, denoted by the gain constants $k_p$ and $k_i$ respectively. Let W(k) be the state variable of the integrator, and $$Q(z)=g_s(1=z^{-\mu})G_p(z)u(z) \tag{4}$$

We then have $$W(z) = \frac{z}{z-1}\ \tilde{e}_s(z) \tag{5}$$

$$\tilde{e}_s(z) = Lz^{-1}(\tau_{sat} - \tau) + e(z) - Q(z) \tag{6}$$

From Eqs.(1),(2),(4),(5), and (6), and taking the inverse z-transformation, we obtain $$t_d(k+1)=t_d(k)+gg_s[u(k-\mu)-\nu(k)] \tag{7}$$

$$W(k+1)=W(k)+Le_{anti}(k)+e(k+1)-Q(k+1) \tag{8}$$

$$Q(k+1)=Q(k)+gg_s[u(k)-u(k-\mu)] \tag{9}$$

where $e_{anti}(z)=\tau_{sat}(z)-\tau(z)$. This set of equations constitute the basic state equation of the TC control loop.

The duty cycle $\tau$ consists of two parts, the feedback and the feedforward part, i.e., $\tau(k)=\tau_{ff}(k)+\tau_{fb}(k)$, where the feed forward part comes from the pixel counter, and is chosen such that $\nu(k)=\tilde{u}\tau_{ff}(k)$. The feedback part of $\tau$ can be written as $$\tau_{fb}(k)=k_p e_s(k)+k_i W(k)=k_p[e(k)-Q(k)]+k_i W(k) \tag{10}$$

Therefore control input u(k) can be written as $$u(k)=\tilde{u}[\tau_{fb}(k)+\tau_{ff}(k)]=\tilde{u}k_p[t_d^T-t_d(k)-Q(k)]+\tilde{u}k_i W(k)+\tilde{u}\tau_{ff}(k) \tag{11}$$

The system delay enters the state equation in the form of $u(k-\mu)$. To treat this term we use the identity $$u(k-\mu)=u(k)+[u(k-\mu)-u(k)]\cong u(k)+u_s(k,k-\mu) \tag{12}$$

Substituting this into Eqs.(7), we obtain $$t_d(k+1)=A_{11}t_d(k)+A_{12}W_k+A_{13}Q(k)+B_1(k,k-\mu) \tag{13}$$

where $A_{11}=1-ugg_sk_p$, $A_{12}=ugg_sk_i$, $A_{13}=-\tilde{u}gg_sk_p$, and $B_1(k,k-\mu)=\tilde{u}gg_sk_pt_d^T+u_s$. In the above equation, it is assumed that the feedforward part from the pixel counter cancels the toner consumption, i.e., $\nu(k)=\tilde{u}\tau_{ff}(k)$. Similarly, From Eqs.(8), (9), (11) and (12), we have $$W(k+1)=A_{21}t_d9k)+A_{22}W(k)+A_{23}Q(k)+B_2(k) \tag{14}$$

$$Q(k+1)=Q(k)+B_3(k,k-\mu) \tag{15}$$

where $A_{21}=-(1-\tilde{u}gg_sk_p)$, $A_{22}=1-\tilde{u}gg_sk_i$, $A_{23}=-(1-\tilde{u}gg_sk_p)$, $B_2(k)=1-\tilde{u}gg_sk_p$, and $B_3(k,k-\mu)=u_s$. These equations can be collected into the state-space matrix form $$x_{k+1}=Ax_k+B_i \tag{16}$$

$$y_k=Cxhd\ k \tag{17}$$

where $$x_k=[t_d(k),W(k),Q(k\ )]^T \tag{18}$$

$$A = \begin{bmatrix} A_{11} & A_{12} & A_{13} \\ A_{21} & A_{22} & A_{23} \\ 0 & 0 & 1 \end{bmatrix} \tag{19}$$

$$B_k=[B_1(k),B_2(k),B_3(k)]^T \tag{20}$$

$$C=[1,0,0] \tag{21}$$

Out approximation for treating the system delay is obtained by replacing $u_s$ by $\hat{u}_s$, the estimated value of $u_s$. The reason behind this approximation is that the delay $\mu$ enters $u_s$ only in the form $[u(k-\mu)-u(k)]$, and the difference between $\hat{u}_s$ and $u_s$ is small compared with $u_s$ itself. Indeed, the simulation results show that the approximation is valid.

So far in our derivation of the system equations we have not considered the TC measurement noise. When the noise is added to the equations we have a new system model $$x_{k+1}=Ax_k+B_k+G\omega_k \tag{22}$$

$$y_k=Cx_k+m_k \tag{23}$$

where $\omega_k$ and $m_k$ are process and measurement noises respectively and matrix $G=[1\ 1\ 1]^T$. The process noise $\omega_k$ is added for the purpose of completing our derivation of the filter shown below. In the practical application of our filter to the control of toner concentration we set the mean square of the process noise $Q=\overline{\omega_k}^2$, to be a very small number. Define at each time k the a priori (before including measurement) estimate $\hat{x}\bar{k}$ and error covariance $P_k^-$, i.e., $P_k^-=\langle(x_k-\hat{x}_k^-)(x_k-\hat{x}_k^-)^T\rangle_{avg}$, and the a posterior (after including measurement) estimate $\hat{x}k$ and $P_k$. By taking the sample average in Eqs.(22), we have $$\bar{x}_{k+1}=A\bar{x}_k+B_k \tag{24}$$

$$P_{x_{k+1}}=AP_{x_k}A^T+GQG^T \tag{25}$$

Similarly, we have $$P_{x_k}^{y_k}=P_{x_k}C^T \tag{26}$$

$$P_{y_k}=CP_{x_k}C^{T+R} \tag{27}$$

where $R=\overline{m_k}^{-2}$.

The goal of the filter is to find the optimal linear estimate of the states $x_k$ given the measurement $y_k$. Thus, $$\hat{x}_kFy_k+g \tag{28}$$

where F and g are constants to be determined by optimizing the mean square error between the measurement and the estimation.

$$\begin{aligned} S &= tr\langle(x_k-\hat{x}k)(x-\hat{x}k)^T\rangle_{avg} \\ &= tr\langle[(x_k-\hat{x}\bar{k})-(Fy_k+g-\hat{x}\bar{k})] \\ &\quad [(x_k-\hat{x}\bar{k})-(Fy_k+g-\hat{x}\bar{k})]^T\rangle_{avg} \\ &= tr\,[P_k^- + F(P_{y_k}+\bar{y}_k\bar{y}_k^T)F^T + (g-\hat{x}\bar{k})(g-\hat{x}\bar{k})^T + \\ &\quad 2F\bar{y}_k(g-\hat{x}\bar{k})^T - 2FP_{y_k^*k}] \end{aligned} \tag{29}$$

Setting the derivatives of S with respect to F and g to zero, we obtain $$F=P_{x_k}^{y_k}P_{y_k}^{-1} \tag{30}$$

$$g=\hat{x}\bar{k}-F\bar{y}_k \tag{31}$$

From these equations, the filter for the system given in Eqs.(22) and (23) consists of the time update part and the measurement update part. The time update part is given by $$\hat{x}_{k+1}^-=A\hat{x}_kB_k \tag{32}$$

$$P_{\bar{k}+1}=AP_kA^T+GQG^T \tag{33}$$

For the measurement update part, $$K_{k+1}=P_{\bar{k}+1}C^T(CP_{\bar{k}+1}C^T(CP_{\bar{k}+1}C^T+R)^{-1} \tag{34}$$

$$P_{k+1}=(1-K_{k+1}C)P_{k+1} \quad (35)$$

$$\hat{x}_{k+1}=\hat{x}_{k+1}+K_{k+1}(y_{k+1}-Cx_{k+1}) \quad (36)$$

where $K_k$ is the time-dependent gain.

As illustrated in FIG. 4, the above noise reduction filter provides multiple levels of noise reduction control. At a first level, filter 128, implemented in memory in control 116 or in sensor 126 filters noise from signals generated by sensor 126 measuring toner concentration. At other levels, filter 128 accounts for a particular degree of toner concentration reference that is used to produce an error signal to control 116. Filter 128 also responds to the current status of toner dispense to the developer system 124. Not only does the filter 128 enable a noise reduction from a given sensor, but enables noise reduction based upon a total system as well as the relatively long delay in the toner delivery process. That is, the filter responds to the dynamics of the entire toner concentration process and ensures a much more precise control.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. In an imaging machine having an imaging member, operating components including a toner dispense system, and a control system including memory to provide images on copy sheets, the toner dispense system comprising:

a source of toner material, a dispenser for transferring toner material from the source to a developer device to replenish the developer device with toner material, a sensor to provide signals representing a degree of toner concentration, a toner concentration reference, a filter interconnected to the sensor and to the toner concentration reference to eliminate error in the signals representing the degree of toner concentration, and a comparator responding to the toner concentration reference and the signals representing the degree of toner concentration to provide an error signal to the control system, the control system providing a toner dispense signal.

2. The imaging machine of claim 1 wherein the filter is responsive to the toner dispense signal.

3. The imaging machine of claim 1 including a toner usage indicator and circuitry responsive to the toner usage indicator and the control system to provide said toner dispense signal.

4. In an imaging machine having an imaging member, operating components including a developer system, and a control system including memory and a toner control reference signal to provide images on copy sheets, the developer system comprising:

a developer device for applying toner material to latent images on the imaging member, a source of toner material, a conduit for transferring toner material from said source to the developer device to replenish the developer device with toner material, a sensor to measure toner concentration in the developer system, the sensor electrically connected to the control to provide the control with signals representing the degree of toner concentration, a dispenser responsive to the control for providing toner material to said conduit, and a filter connected between the sensor and the control to reduce noise in the signals representing the toner concentration being conveyed from the sensor to the control, the filter being responsive to the reference signal.

5. The imaging machine of claim 4, wherein the filter provides multiple levels of noise control and including a toner concentration reference.

6. The imaging machine of claim 4 wherein the filter responds to the status of the dispenser.

7. The imaging machine of claim 4 wherein the filter is embedded in the sensor.

8. The imaging machine of claim 4 wherein the filter comprises a representation of the dynamics of toner concentration within the imaging machine.

9. In an imaging machine having an imaging member, operating components including a toner dispense system, and a control system including memory to provide images on copy sheets, the toner dispense system comprising:

a source of toner material, a dispenser for transferring toner material from the source to a developer device to replenish the developer device with toner material, a sensor to measure toner concentration in the developer device, the sensor electrically connected to the control to provide the control with signals representing the degree of toner concentration, and a filter interconnected to the sensor and the control to eliminate error in the signals representing the degree of toner concentration being conveyed from the sensor to the control, the filter providing multiple levels of noise control including feedback to the dispenser and response to a toner concentration reference signal.

10. The imaging machine of claim 9 wherein the filter is embedded in the sensor.

11. The imaging machine of claim 9 wherein the filter comprises a representation of the dynamics of toner concentration within the imaging machine.

12. In an imaging machine having an imaging member, operating components including a developer system, and a control system including memory to provide images on copy sheets, the developer system comprising:

a developer device for applying toner material to latent images on the imaging member, a source of toner material, a conduit for transferring toner material from said source to the developer device to replenish the developer device with toner material, a sensor to measure toner concentration in the developer system, the sensor electrically connected to the control to provide the control with signals representing the degree of toner concentration, a dispenser responsive to the control for providing toner material to said conduit, and a filter connected between the sensor and the control to reduce noise in the signals representing the toner concentration being conveyed from the sensor to the control wherein the filter is defined by the relationships $$\hat{x}_{k+1}+A\hat{x}_k\hat{B}_k$$

$$P_{k\bar{k}+1}=A_{eff}P_kA_{eff}^T+GQG^T$$

$$K_{k+1}=P_{\bar{k}+1}C^T(CP_{\bar{k}+1}C^T+R)^{-1}$$

$$P_{k+1}=(1-K_{k+1}C)P_{\bar{k}+1}$$

$$\hat{x}_{k+1}=\hat{x}_{\bar{k}+1}+K_{k+1}(y_{k+1}-C\hat{x}_{\bar{k}+1}).$$

13. The imaging machine of claim 12, wherein the filter incorporates the dynamics of toner concentration within the imaging machine.

14. In an imaging machine having an imaging member, operating components including a toner dispense system, and a control system including memory to provide images on copy sheets, the toner dispense system comprising:

a source of toner material, a dispenser for transferring toner material from the source to a developer device to replenish the developer device with toner material, a sensor to measure toner concentration in the developer device, the sensor electrically connected to the control to provide the control with signals representing the degree of toner concentration, and a filter interconnected to the sensor and the control to eliminate error in the signals representing the degree of toner concentration being conveyed from the sensor to the control wherein the filter is defined by the relationships $$\hat{x}_{\bar{k}+1}=A\hat{x}_k+\hat{B}_k$$

$$P_{\bar{k}+1}=A_{eff}P_kA_{eff}^T+GQG^T$$

$$K_{k+1}=P_{\bar{k}+1}C^T(CP_{\bar{k}+1}C^T+R)^{-1}$$

$$P_{k+1}=(1-K_{k+1}C)P_{\bar{k}+1}$$

$$\hat{x}_{k+1}=\hat{x}_{\bar{k}+1}K_{k+1}(y_{k+1}-C\hat{x}_{\bar{k}+1}).$$

15. The imaging machine of claim 14, wherein the filter reduces effective noise in the signals being conveyed from the sensor to the control.

16. The imaging machine of claim 14 including a toner control reference signal and wherein the filter is responsive to the reference signal.

17. The imaging machine of claim 14 wherein the filter is embedded in the sensor.

18. The imaging machine of claim 14 wherein the filter comprises a representation of the dynamics of toner concentration within the imaging machine.

* * * * *